US007160662B2

(12) United States Patent
Yoshino et al.

(10) Patent No.: US 7,160,662 B2
(45) Date of Patent: Jan. 9, 2007

(54) ELECTROSTATIC LATENT IMAGE DEVELOPING AGENT AND IMAGE FORMING METHOD

(75) Inventors: Susumu Yoshino, Minamiashigara (JP); Yoshifumi Iida, Minamiashigara (JP); Seki Yamaguchi, Minamiashigara (JP); Motoko Sakai, Minamiashigara (JP); Sueko Sakai, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 127 days.

(21) Appl. No.: 10/732,318

(22) Filed: Dec. 11, 2003

(65) Prior Publication Data

US 2004/0234877 A1 Nov. 25, 2004

(30) Foreign Application Priority Data

May 20, 2003 (JP) ..... 2003-141514

(51) Int. Cl.
*G03G 9/113* (2006.01)
*G03G 9/08* (2006.01)

(52) U.S. Cl. ..... 430/108.3; 430/108.1; 430/108.7; 430/110.3; 430/111.1; 430/111.35; 430/111.41; 430/120; 430/125

(58) Field of Classification Search ..... 430/111.1, 430/111.32, 111.35, 111.41, 108.7, 108.1, 430/110.3, 108.3, 120, 124, 125, 126
See application file for complete search history.

(56) References Cited

U.S. PATENT DOCUMENTS 5,215,848 A * 6/1993 Ikeda et al. ..... 430/111.1
5,340,677 A * 8/1994 Baba et al. ..... 430/111.35
5,797,070 A * 8/1998 Waki et al. ..... 399/149
6,054,241 A * 4/2000 Yamamoto et al. ..... 430/111.32
6,383,704 B1 * 5/2002 Kataoka et al. ..... 430/108.6
6,818,370 B1 * 11/2004 Uchinokura et al. ... 430/108.22
2002/0022190 A1 * 2/2002 Iizuka et al. ..... 430/110.4
2002/0172880 A1 * 11/2002 Takayanagi et al. ... 430/108.23

FOREIGN PATENT DOCUMENTS

| | | |
|---|---|---|
| JP | A 59-52255 | 3/1984 |
| JP | A 60-112052 | 6/1985 |
| JP | A 61-80161 | 4/1986 |
| JP | A 61-80162 | 4/1986 |
| JP | A 61-80163 | 4/1986 |
| JP | A 4-40467 | 2/1992 |
| JP | A 6-208241 | 7/1994 |
| JP | A 8-160659 | 6/1996 |
| JP | A 8-160674 | 6/1996 |
| JP | A 2001-22133 | 1/2001 |

* cited by examiner

*Primary Examiner*—Janis L. Dote
(74) *Attorney, Agent, or Firm*—Oliff & Berridge, PLC

(57) ABSTRACT

The present invention relates to an image forming method including: a charging step; an electrostatic latent image forming step; a developing step; a transfer step; a fixing step; and a cleaning step, wherein an electrostatic latent image developing agent comprises a toner and a carrier, wherein particles which have a volume resistivity of at least $1\times10^{14}$ Ωcm and an average primary particle diameter of 50 nm or less has a higher covering ratio than other particles on the toner particle surfaces, a shape factor SF1 of the toner is in the range of from 100 to 140, the carrier is a resin coated carrier, and at least a coating resin layer comprises a positively charging resin and a quaternary ammonium salt compound.

18 Claims, 1 Drawing Sheet

ELECTROSTATIC LATENT IMAGE DEVELOPING AGENT AND IMAGE FORMING METHOD

CROSS-REFERENCE TO RELATED APPLICATION

This application claims priority under 35 USC 119 from Japanese patent Application No. 2003-141514, the disclosure of which is incorporated by reference herein.

BACKGROUND OF THE INVENTION

1. Field of the Invention

The present invention relates to an electrostatic latent image developing agent used in electrophotography, electrostatic recording, and electrostatic printing. The invention relates also to an image forming method using the electrostatic latent image developing agent.

2. Description of the Related Art

Recently, a method for visualizing image information by utilizing an electrostatic latent image, such as electrophotography, has become popular in various fields. Conventionally, in electrophotography, a latent image is formed on a photoreceptor or an electrostatic recording medium and charge detecting particles called toner are adhered to the electrostatic latent image to develop and visualize the latent image.

Electrostatic latent image developing agents (hereinafter also referred to as "developing agents") are classified, in a broad sense, into a two-component developing agent and a one-component developing agent. When the two-component developing agent is used, a bearing particle called a carrier and a toner particle are charged by friction between the carrier and the toner particle, whereby a proper quantity of positive or negative charge is imparted to the toner particle. When the one-component developing agent is used, a toner is used alone as in the case of a magnetic toner. In particular, the two-component developing agent is widely used because the design is easier in the case of the two-component developing agent. This is because the carrier in the two-component developing agent may have functions such as agitating, transporting, and imparting charge, that is, the functions required for a developing agent can be separated and allotted to each of the carrier and the toner.

However, since the two-component developing agent utilizes frictional charging for charging the toner particles, the charge level is changed easily by the influence of environmental change. That is, generally, the charge level tends to be high in a condition of low temperature and low humidity, while the charge level tends to be low in a condition of high temperature and high humidity. Hence, the two-component developing agent has had problems of: reduction in density when the charge level of the toner is made high by a change in the environment; and fog generation when the charge level of the toner is made low by changes in environment.

Manufacturing methods of a toner are classified in a broad sense into a dry method, which uses a conventional melt-kneading pulverization method, and a wet method, in which a toner particle is produced in a solution. The wet method is becoming valued highly from the viewpoints of decreasing the particle size of the toner, narrowing particle size distribution, providing wider freedom of shape control, and reducing energy cost in manufacture. However, since toner particles are formed in a solution in the wet method, a hydrophilic group tends to remain on a surface of a toner particle. And since such a remaining hydrophilic group makes the particles high hygroscopic at a high humidity, charging characteristics tend to be deteriorated. Hence, conventional developing agents containing a toner obtained by means of a wet method has had a fault that charging characteristics are degraded at a high humidity.

Since a spherical toner obtained by the wet method has a larger contact area with a carrier, it takes quite a long time for the toner itself to reach a saturation charge quantity. Therefore, when such a toner is used in an actual apparatus, charge quantities of individual toner particles tend to vary, which has led toward a broader toner charge distribution.

In order to improve characteristics such as toner preservability (blocking resistance), transportability, developing property, transferability, and charging property, the molecular weight, the glass transition temperature, and the melting temperature of a binder resin are controlled. In addition, an organic/inorganic particle called an external additive is added on the surface of the toner particle.

Examples of the inorganic particles include hydrophobic powders represented by hydrophobic silica, silica particles further containing alumina or titania, inorganic particles having a hydrophobicity distribution. However, none of the cited inorganic particles can satisfy both the charge stability with respect to the environmental change and the charge retaining characteristic.

Alternatively, there have been proposed surface treated inorganic compounds used as external additives, such as hydrophobicity-imparted vapor phase titanium oxide; hydrophobicity-imparted anatase type titanium oxide; titania particle which has been surface-treated with a coupling agent; and titanium oxide or alumina whose surface has been subjected to an organic treatment and which has a methanol wettability half value of 55% or more (see Japanese Patent Application Laid-Open (JP-A) Nos. 59-52255, 60-112052, 4-40467 and 8-160659). Such surface-treated inorganic compounds still have a problem that the charge retaining characteristic is not satisfactory, though charge stability with respect to the environmental change is somewhat improved.

Furthermore, there has been proposed a surface-treated titanium oxide particle having a total content of water-soluble components of no higher than 0.2% by mass, with attention given to a core material (see, for example, JP-A No. 6-208241). Such a surface-treated titanium particle also still has the problem that the charge retaining characteristic is not satisfactory, though charge stability with respect to the environmental change is somewhat improved.

Various kinds of resin-coated carriers have been studied mainly from the viewpoint of obtaining good charging characteristics. Regarding the effect of a coating resin on the charging properties of the resin-coated carrier, the change in charge accompanied by a change in the environment (environmental dependency) tends to be large when a resin with a higher charging ability is used. For example, a carrier including polymethyl methacrylate as a coating resin has a higher charging level and a larger environmental dependency than a carrier including polystyrene as a coating resin. That is, in general, a resin material having a group with a higher polarity has not only a higher charge level but also larger environmental dependency. On the other hand, in general, a resin material with a lower polarity has not only a lower charge level but also better environmental dependency. As is explained above, it is difficult for each of a toner and a carrier to have both a desired charge level and charging characteristics with small environmental dependency.

Further, a carrier has to have charge retaining characteristic, which means that a desired charge level of the carrier can be retained for a long period of time.

There are problems that a toner component adheres to a surface of a carrier and fixed thereon and that the coating resin of the carrier peels off owing to stress over time. In order to solve such problems, it is proposed that fluororesin, silicone resin, or the like should be used to reduce the surface energy of the coating resin to protect the carrier surface from contamination and that a strength of a coating resin should be raised to suppress peeling-off or breaking-off of the coating resin. However, because low surface energy material has inferior contact characteristics with a core material, it is very difficult to have both contamination resistance and peeling-off resistance simultaneously.

For solving such a problem, a coated carrier coated with a copolymer of a nitrogen-containing fluorinated alkyl (meth)acrylate and a vinyl based monomer, a copolymer of a fluorinated alkyl (meth)acrylate and a nitrogen-containing vinyl based monomer, or the like is proposed (see, for example, JP-A Nos. 61-80161, 61-80162 and 61-80163). This coated carrier has a relative long lifetime and hard to contaminate with a toner and an external additive. However, since a fluororesin has poor charging ability, when a fluororesin is copolymerized with a nitrogen-containing vinyl based monomer having a polar group with a high charging property or with a methyl methacrylate ester monomer having a polar group with a high charging property, the environmental dependency is degraded.

A carrier has been proposed in which an organic charge controlling agent is incorporated in a polyolefin resin coat or in a surface region thereof (see, for example, JP-A No. 8-160674). This carrier is designed aiming at imparting charge environmental stability to the carrier and making it difficult for a charge controlling agent to be separated from the coating resin. Even with this polyolefin resin, however, a problem arises that contamination by a toner component cannot be sufficiently reduced and good charge retainability cannot be obtained.

A carrier has been proposed in which a quaternary ammonium salt compound having the tendency to positively charging when mixed with iron powder is incorporated in a coating resin layer to thereby control the toner charge stably (see, for example, JP-A No. 2001-22133). Also in the case of such a carrier, a problem has arisen that contamination by a toner component cannot be sufficiently reduced such that good charge retainability cannot be obtained.

As described above, it has been very difficult to simultaneously satisfy high charge level, excellent charge retainability, excellent environmental stability, satisfactory contamination resistance and satisfactory durability, which are required for reliability of carrier.

Accordingly, even when particles added onto a toner and coating resin on a carrier are carefully prepared, it is not easy to obtain both the excellent charge environmental stability and the excellent charge retainability. Further, there has been no effective means to narrow a charge quantity distribution, especially, in a case where a spherical toner is used.

SUMMARY OF THE INVENTION

The present invention has been made in order to solve the problems in the prior art.

That is, it is an object of the invention to provide an electrostatic latent image developing agent having excellent charging property, charge retainability, environmental stability, and a narrow charge quantity distribution even in a case where a spherical toner is used. It is another object of the invention to provide an image forming method using such an electrostatic latent image developing agent to form a high quality image.

The present inventors have conducted intensive studies in order to solve the above problems and found that by allowing a specific additive to adhered onto a surface of a toner particle included in an electrostatic latent image developing agent and by coating a surface of a carrier with a specific material, it becomes possible to provide a electrostatic latent image developing agent having excellent charge environmental stability and excellent retainability even if the toner and an external additive is attached to the carrier and that by using the specific additive, an initial charging and charge environmental stability are improved to higher levels. Furthermore, as a result of the studies, findings has been obtained that by using a specific toner together with the carrier, in addition to the above characteristics, transferablity can be improved thereby enabling a high quality image to be formed.

<1> That is, one aspect of the invention is to provide an electrostatic latent image developing agent comprising a toner and a carrier, wherein:

the surface of the toner is covered with one or more kinds of particles;

at least one kind of the one or more kinds of particles has a volume resistivity of $1\times10^{14}$ Ωcm or greater and an average primary particle diameter of 50 nm or less;

a total covering ratio of said at least one kind of particles is higher than a total covering ratio of other kinds of particles on the surface of the toner;

a shape factor SF1 of the toner is in the range of from 100 to 140;

the carrier is a resin coated carrier; and at least a coating resin layer of the carrier contains a positively charging resin and a quaternary ammonium salt compound.

<2> Another aspect of the invention is to provide an image forming method comprising: at least, a charging step of charging a surface of an electrostatic latent image bearing member; an electrostatic latent image forming step of forming an electrostatic latent image on the surface of the electrostatic latent image bearing member; a developing step of transforming the latent image into a toner image using an electrostatic latent image developing agent; a transfer step of transferring the toner image formed on the surface of an electrostatic latent image bearing member onto a surface of a receiving substrate; a fixing step of thermally fixing the toner image transferred onto the surface of the receiving substrate; and a cleaning step of removing the toner remaining on the electrostatic latent image bearing member, wherein the electrostatic latent image developing agent includes a toner and a carrier, wherein:

the surface of the toner is covered with one or more kinds of particles;

at least one kind of the one or more kinds of particles has a volume resistivity of $1\times10^{14}$ Ωcm or greater and an average primary particle diameter of 50 nm or less;

a total covering ratio of said at least one kind of particles is higher than a total covering ratio of other kinds of particles on the surface of the toner;

a shape factor SF1 of the toner is in the range of from 100 to 140;

the carrier is a resin coated carrier; and at least a coating resin layer of the carrier contains a positively charging resin and a quaternary ammonium salt compound.

In the invention, the volume resistivity of the carrier is preferably in the range of from $1\times10^9$ to $1\times10^{13}$ Ωcm and the exposure ratio of the core material component of the carrier is preferably 20% or less.

The toner is preferably a toner manufactured by means of a wet method. The particles are made of silicone-treated silica.

DETAILED DESCRIPTION OF THE INVENTION

Figure 1:
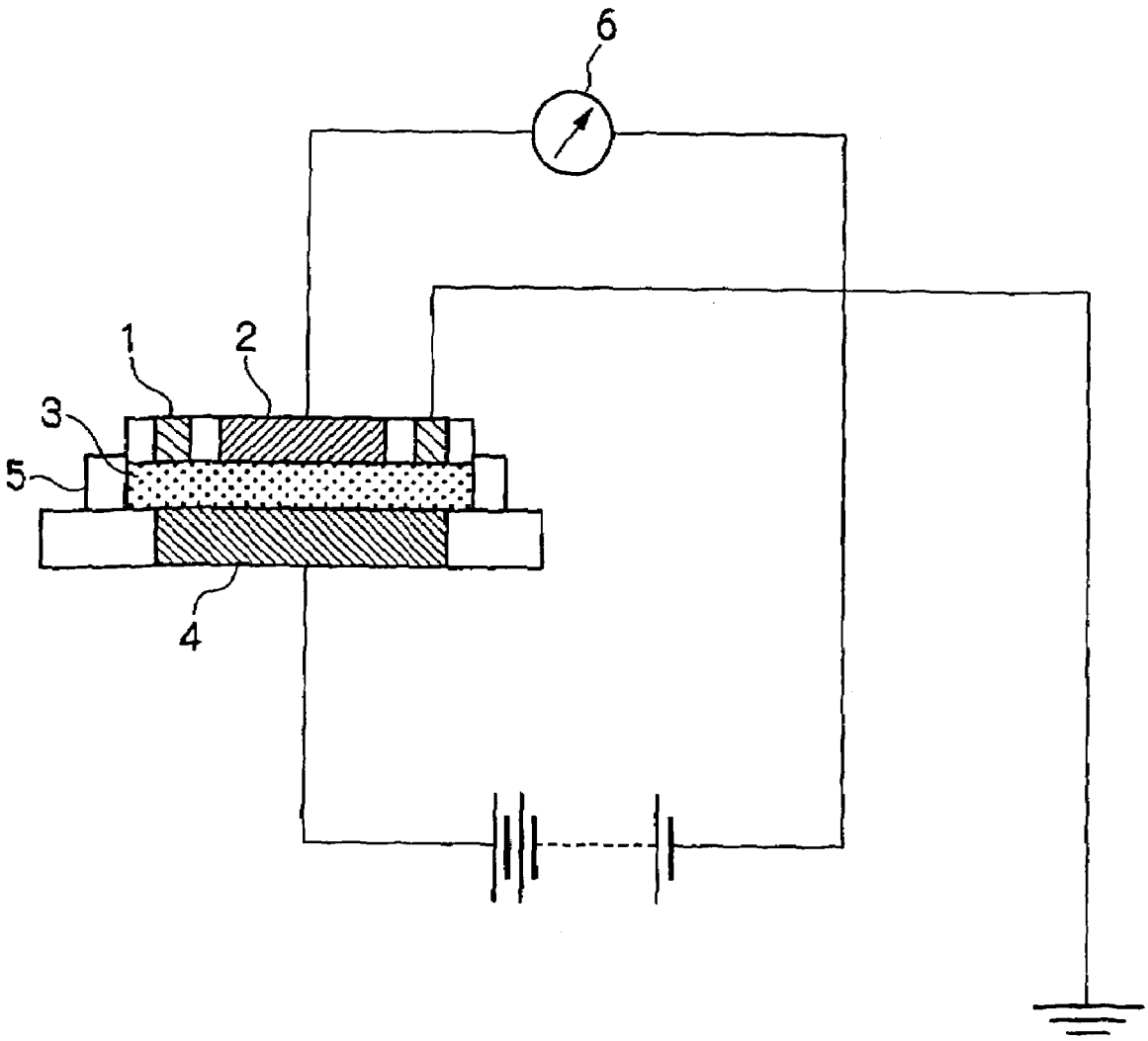
FIG. 1 is a schematic view describing a method of measuring a volume resistivity.

The present invention will be described in detail below.

One embodiment of the present invention is an electrostatic latent image developing agent (P) comprising a toner and a carrier, wherein:

the surface of the toner is covered with one or more kinds of particles;

at least one kind of the one or more kinds of particles has a volume resistivity of $1\times10^{14}$ Ωcm or greater and an average primary particle diameter of 50 nm or less;

a total covering ratio of said at least one kind of particles is higher than a total covering ratio of other kinds of particles on the surface of the toner;

a shape factor SF1 of the toner is in the range of from 100 to 140;

the carrier is a resin coated carrier; and at least a coating resin layer of the resin coated carrier comprises a positively charging resin and a quaternary ammonium salt compound.

Another embodiment of the invention is the electrostatic latent image developing agent (P), wherein a volume resistivity of the carrier is in the range of from $1\times10^9$ Ωcm to $1\times10^{13}$ Ωcm.

Another embodiment of the invention is the electrostatic latent image developing agent (P), wherein a core material component exposure ratio of the carrier is 20% or less.

Another embodiment of the invention is the electrostatic latent image developing agent (P), wherein the toner is manufactured by a wet method.

Another embodiment of the invention is the electrostatic latent image developing agent (P), wherein the particles comprise silicone-treated silica.

Another embodiment of the invention is the electrostatic latent image developing agent (P), wherein a content of the quaternary ammonium salt compound is in the range of from 1 to 60 parts by mass per 100 parts by mass of the positively charging resin.

Another embodiment of the invention is the electrostatic latent image developing agent (P), wherein an amount of the positively charging resin is in the range of from 0.05 to 5.0% by mass with respect to a total mass of the carrier.

Another embodiment of the invention is the electrostatic latent image developing agent (P), wherein an average film thickness of the positively charging resin is in the range of from 0.1 to 10 μm.

Another embodiment of the invention is the electrostatic latent image developing agent (P), wherein a volume resistivity of the carrier is in the range of from $10^9$ to $10^{13}$ Ωcm at a development contrast potential in the range of from $10^3$ to $10^4$ V/cm.

Another embodiment of the invention is the electrostatic latent image developing agent (P), wherein an amount of the particles is in the range of from 0.3 to 5 parts by mass per 100 parts by mass of the toner.

Another embodiment of the invention is the electrostatic latent image developing agent (P), wherein a volume average particle diameter of the toner is in the range of from 2 to 12 μm.

Another embodiment of the invention is the electrostatic latent image developing agent (P), wherein a ratio of a volume average particle diameter of the carrier to a volume average particle diameter of the toner is in the range of from 2:1 to 15:1.

Another embodiment of the invention is an image forming method (Q) comprising at least a charging step of charging a surface of an electrostatic latent image bearing member; an electrostatic latent image forming step of forming an electrostatic latent image on the surface of the electrostatic latent image bearing member; a developing step of transforming the electrostatic latent image into a toner image by using an electrostatic latent image developing agent; a transfer step of transferring the toner image formed on the surface of the electrostatic latent image bearing member onto a surface of a receiving substrate; a fixing step of thermally fixing the toner image transferred onto the surface of the receiving substrate; and a cleaning step of removing the toner remaining on the surface of the electrostatic latent image bearing member, wherein:

the electrostatic latent image developing agent comprises a toner and a carrier;

the surface of the toner is covered with one or more kinds of particles;

at least one kind of the one or more kinds of particles has a volume resistivity of $1\times10^{14}$ Ωcm or greater and an average primary particle diameter of 50 nm or less;

a total covering ratio of said at least one kind of particles is higher than a total covering ratio of other kinds of particles on the surface of the toner;

a shape factor SF1 of the toner is in the range of from 100 to 140;

the carrier is a resin coated carrier; and at least a coating resin layer of the resin coated carrier comprises a positively charging resin and a quaternary ammonium salt compound.

Another embodiment of the invention is the image forming method (Q), wherein a volume resistivity of the carrier is in the range of from $1\times10^9$ Ωcm to $1\times10^{13}$ Ωcm.

Another embodiment of the invention is the image forming method (Q), wherein a core material component exposure ratio of the carrier is 20% or less.

Another embodiment of the invention is the image forming method (Q), wherein the toner is manufactured by a wet method.

Another embodiment of the invention is the image forming method (Q), wherein the particles comprise silicone-treated silica.

Still another embodiment of the invention is the image forming method (Q), wherein a content of the quaternary ammonium salt compound is in the range of from 1 to 60 parts by mass per 100 parts by mass of the positively charging resin.

<Electrostatic Latent Image Developing Agent>

An electrostatic latent image developing agent of the invention comprises a toner and a carrier, wherein:

the surface of the toner is covered with one or more kinds of particles;

at least one kind of the one or more kinds of particles has a volume resistivity of $1\times10^{14}$ Ωcm or greater and an average primary particle diameter of 50 nm or less;

a total covering ratio of said at least one kind of particles is higher than a total covering ratio of other kinds of particles on the surface of the toner;

a shape factor SF1 of the toner is in the range of from 100 to 140;

the carrier is a resin coated carrier; and at least a coating resin layer of the carrier contains a positively charging resin and a quaternary ammonium salt compound.

The present inventors have found that by adding a specific additive onto surfaces of a toner included in a developing agent and by coating the carrier with a specific material, an electrostatic latent image developing agent can be obtained that has a charge environmental stability and excellent charge retainability even if a toner and an external additive are attached to the carrier. The present inventors have further found that by using such a carrier, even in a case where spherical toner is used, an initial charing characteristic can be improved to a higher level.

It is necessary that the surface of the toner of the invention should be covered with at least one kind of particles (which are occasionally referred to as "specific particles" hereinafter) which has a volume resistivity of $1\times10^{14}$ Ωcm or greater and an average primary particle diameter of 50 nm or less, that a total covering ratio of said at least one kind of particles should be higher than a total covering ratio of other kinds of particles on the surface of the toner, and that the shape factor of the toner should be in the range of from 100 to 140.

The shape factor SF1 of a toner, in the invention, means the average of values that are obtained by the following formula for individual toner particles:

$$SF1=(ML^2/A)\times(\pi/4)\times100$$

wherein in the formula, ML indicates the maximum length of the toner particles, A indicates the projected area of each toner particle, wherein in a case of a perfect sphere, SF1=100.

In order to improve characteristics such as toner preservability (blocking resistance), transportability, developing property, transferability, a charging property, organic or inorganic particles are attached onto a surface of a toner particle. While various particles are used in some case especially in order to obtain charge stability, it is important that volume resistivity of at least one kind of particles which has an average primary particle diameter of 50 nm or less and is added mainly to the surface of the toner should be $1\times10^{14}$ Ωcm or more.

Fluidity of a toner depends on the diameter of the toner and the shape of the toner. In addition, the fluidity of the toner depends also on the particle diameter of an additive attached onto a surface of the toner. A smaller additive increases the fluidity of the toner. Therefore, it is effective from the viewpoint of fluidity improvement to cover the toner surfaces with at least one kind of particles having an average primary diameter 50 nm or less. In a case where several kinds of additives are used as well as in a case where only one kind of additive is used, it is necessary that the surface of the toner should be covered with at least one kind of particles which has an average primary particle diameter of 50 nm or less and that a total covering ratio of said at least one kind of particles should be higher than a total covering ratio of other kinds of particles on the surface of the toner.

The average particle diameter of the at least one kind of particles is preferably 30 nm or less and more preferably 20 nm or less. The lower limit of the average primary particle diameter is on the order of 5 nm from the viewpoint that the particles have to be embedded in a toner surface to a certain degree.

The higher a covering ratio of particles on a surface of the toner is, the higher the contact frequency thereof with a carrier is; therefore the higher the probability of migration of the particles to the carrier is. Further, the particles having small particle diameters are harder to separate off once such particles are attached onto the carrier. Accordingly, in this case, the charge imparting ability of the carrier tends to decline.

It was found owing to intensive studies by the inventors that in a case where the carrier was contaminated by migration of the external additive, the degree of degradation of the carrier differs based on the kind of the material of the external additive. The inventors also found that an electric resistance of the external additive greatly affects the degradation of the carrier and that the larger the electric resistance of an external additive is, the smaller the degree of the degradation of the carrier. Specifically, the volume resistivity of the particle to be added onto the surface of the toner has to be $1\times10^{14}$ Ωcm or higher.

The volume resistivity of the particle is preferably $1\times10^{15}$ Ωcm or larger and more preferably $1\times10^{16}$ Ωcm or larger.

Considering such characteristics of the particles, according to the invention, in order to achieve the effects of the invention fully, it is necessary that the surface of the toner should be covered with one or more kinds of particles, that at least one kind of the one or more kinds of particles has a volume resistivity of $1\times10^{14}$ Ωcm or greater and an average primary particle diameter of 50 nm or less, that a total covering ratio of said at least one kind of particles is higher than a total covering ratio of other kinds of particles on the surface of the toner.

A covering ratio of particles on a particle surface of the toner is expressed by the following formula. In the invention, a total covering ratio of at least one kind of particles which has a volume resistivity of $1\times10^{14}$ Ωcm or greater and an average primary particle diameter of 50 nm of less have to be higher than a total covering ratio of other kinds of particles on the surface of the toner. Specifically, the total covering ratio of said at least one kind of particles is preferably in the range of from 10 to 150% and more preferably in the range of from 20 to 70%.

$$\text{Covering Ratio}(\%)=(\sqrt{3}/2\pi)\cdot(D\cdot\rho t)/(d\cdot\rho a)\cdot C\cdot100$$

wherein D represents the volume average particle diameter (μm) of a toner, d represents an average primary particle diameter of the particles (nm), ρt represents the specific gravity of the toner, ρa represents a specific gravity of the particles and C represents the mass ratio of the particles relative to the toner.

A carrier in the invention is a resin coated carrier as described above and at least a coating resin layer has to contain a positively charging resin and a quaternary ammonium salt compound.

The surface of a carrier has to be coated with a resin in order to improve charge environmental stability and charge retainability as described above. In order to charge a toner negatively, a positively charging resin is generally used as the resin.

The positively charging resin according to the invention is a resin which, in terms of the electrification series, which has a stronger tendency to charge positively than Mn—Mg ferrite. An electrification tendency of a resin relative to the Mn—Mg ferrite can be confirmed by measuring a charge quantity of the resin in powder form when the resin powder is mixed with Mn—Mg ferrite, or by measuring a potential of the resin surface when Mn—Mg ferrite powder is caused to roll down a surface of an inclined substrate coated with the resin.

The inventors conducted further intensive studies and found that by allowing the positively charging resin coated on a carrier to include dispersed a quaternary ammonium salt compound, a high charging property can be imparted to a toner and charge environmental stability is ensured.

A quaternary ammonium salt compound described above is hydrophilic and somewhat conductive supposedly due to its salt structure. Thus, it is difficult to accumulate an excessive charge on a quaternary ammonium compound. Accordingly, a quaternary ammonium compound is useful for preventing an excessive electrification when an environment changes and is useful for preventing an excessive electrification especially under an environment of a low temperature and a low humidity. However, because a quaternary ammonium salt compound does not have a sufficient ability to impart a high negative charge to an object, it is difficult to use a quaternary ammonium compound as an electric charge imparting material. Therefore, the resin in which a quaternary ammonium salt compound is dispersed has to be a highly positively charging resin, which imparts a negative charge to an object. It is considered that while the negative charge imparting resin, which is a highly positively charging resin, strongly imparts a negative charge to a toner, a quaternary ammonium compound dispersed in the negative charge imparting resin functions as a charge leaking site to prevent an excessive electrification in a case where the negative charge imparting ability of the negative charge imparting resin becomes too strong under an environment of a low temperature and a low humidity. In this way, the negative charge imparting resin can impart a proper charge to the toner.

A toner used in the invention is a so-called spherical toner having a shape factor SF1 in the range of from 100 to 140 as described above. As mentioned above, accordingly, initial charging rates of the respective toner particles vary. This variation of the initial charging rate easily broadens the charge quantity distribution of the entire toner particles in a developing agent.

As mentioned above, according to the invention, the charge retainability and the charge enviromental stability of a electrostatic latent image developing agent can be improved by the combination of the specific particle provided on a surface of a toner and the specific coating resin provided on a carrier. Moreover, it has also been found that by the combination, an initial charging rate of each toner particle is increased and an electrification quantity distribution of spherical toner particles becomes narrower.

The inventors have also found that sufficient charge environmental stability of the carrier according to the invention is obtained regardless of a composition of an external additive which is added to the toner.

Materials of external additives which are effective for the charge environmental stability are generally particles showing conductivity or semiconductivity such as titania. Titania is a semiconductive material and is still semiconductive even after titania is subjected to a surface-treatment such as hydrophobicity imparting treatment. Hence, in a case where titania is attached onto a carrier to contaminate it, the carrier is greatly deteriorated. On the other hand, particle material such as silica or the like showing a high volume resistivity as high as $1\times10^{14}$ Ωcm or greater has very poor charge environmental stability, though such particles have better properties with regard to the carrier degradation. If a carrier according to the invention is used together with a toner provided with the particles having high resistivity, a good charge environmental stability can be attained. Moreover, since the particles having high resitivity do naturally not deteriorate a carrier, the developing agent according to the invention can satisfy both the charge environmental stability and the charge retainability.

Specific description will be given below of materials of a carrier and a toner used in the invention and manufacturing methods thereof.

(Carrier)

A resin coating a surface of a core of a carrier may be either thermoplastic or thermosetting and preferable is a thermosetting resin. This is because while a thermosetting resin is have to be subjected to a high temperature treatment for curing, an excessively high temperature may decompose a quaternary ammonium salt compound.

No specific limitation is imposed on the positively charging resin. For example, if the positively charging resin is a thermoplastic resin, a total amount of:

monomers each including a carboxyl group;

alkyl (meth)acrylate ester monomers each including a linear alkyl group with 1 to 3 carbon atoms; and an alkyl (meth)acrylate ester monomers each including a linear alkyl group with 4 to 10 carbon atoms or a branched alkyl group having 3 to 10 carbon atoms;

is at least 50% by mass based on a total amount of monomers in a coating resin. Further in a case where a monomer containing a fluorine atom is additionally included in the resin, an amount of the monomer containing a fluorine atom is preferably no greater than 10% by mass based on a total amount of the monomers in the coating resin.

A resin comprising the monomer including the carboxyl group and a resin comprising the monomer including the alkyl (meth)acrylate ester are effective for obtaining a high positively charging tendency and also effective for improving contact characteristics between the coating resin and the core of the carrier and ensuring durability. However if the total amount of the above-cited monomers is less than 50% by mass based on the total amount of monomers in the coating resin, sufficient positively charging tendency cannot be ensured. While a resin comprising a monomer containing a fluorine atom can attain contamination resistance, if the fluorine-atom-containing monomer is included in the coating resin in an amount of no less than 10% by mass, the positively charging tendency of the coating resin sometimes becomes insufficient due to large electronegativity of a fluorine atom.

Homopolymers and copolymers of the monomers have the characteristics according to the invention. Random polymerization method, graft polymerization method, and the like can be cited as examples of copolymerization method.

Examples of the monomer including a carboxyl group include unsaturated carboxylic acids such as (meth)acrylic acid, vinylacetic acid, allylacetic acid, and 10-undecenoic acid; styrene derivatives each having a carboxyl group such as carboxylstyrene; and styrene derivatives each having two or more carboxyl groups such as p-carboxylstyrene.

The alkyl (meth)acrylate ester monomer including a linear alkyl group having 1 to 3 carbon atoms may be, for example, methyl (meth)acrylate, ethyl (meth)acrylate, or n-propyl (meth)acrylate. The alkyl (meth)acrylate ester monomer including a linear alkyl group having 4 to 10 carbon atoms or a branched alkyl group having 3 to 10 carbon atoms may be, for example, isopropyl (meth)acrylate, n-butyl (meth) acrylate, tertiary butyl (meth)acrylate, isobutyl (meth)acrylate, tertiary pentyl (meth)acrylate, n-pentyl (meth)acrylate, isopentyl (meth)acrylate, n-hexyl (meth)acrylate, isohexyl (meth)acrylate, or cyclohexyl (meth)acrylate.

Note that while fluororesin and silicone resin have been known as carrier coating resins, each of the resins alone cannot be used as a positively charging resin according to the invention.

On the other hand, examples of thermosetting resins include polyurethanes, amino resins, melamine resins, benzoguanamine resins, urea resins, and amide resins. However, the thermosetting resins usable in the invention are not limited to these examples.

The quaternary ammonium salt compound is particularly preferably represented by the following formulae (1) and (2) and plural kinds of such quaternary ammonium compounds may be used in combination.

(1)

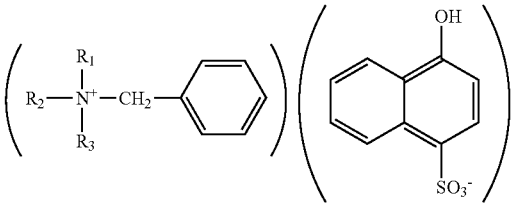

wherein in the formula (1), $R_1$ through $R_3$ each independently represent a group expressed by $C_nH_{2n+1}$; n is an integer from 1 to 10; and $R_1$ through $R_3$ may be same as or different from one another.

(2)

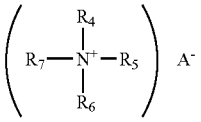

wherein in the general formula (2), $R_4$ through $R_7$ each independently represent a hydrogen atom, an alkyl group having 1 to 22 carbon atoms or an alkenyl group having 1 to 22 carbon atoms, an unsubstituted or substituted aromatic group having 1 to 20 carbon atoms, or an aralkyl group having 7 to 20 carbon atoms; and $A^-$ represents a molybdic acid anion, a tungstic acid anion, a heteropoly-acid anion containing a molybdenum atom or a tungsten atom.

An example of a compound having a structure expressed by the formula (1) is BONTRON P-51 (manufactured by Orient Chemical Industries Ltd.) and examples of a compound of a structure expressed by the formula (2) are TP-302, TP-415 and TP-610 (all being manufactured by Hodogaya Chemical Ltd.).

A content of a quaternary ammonium salt compound is preferably in the range of from 1 to 60 parts by mass and more preferably in the range of from 5 to 30 parts by mass per 100 parts by mass of a coating resin.

If the content is less than 1 part by mass, a quaternary ammonium salt compound may fail to exhibit the charge leakage effect sufficiently. On the other hand, if the content exceeds 60 parts by mass, the coating resin may become hygroscopic to reduce a toner charging property thereof.

A core material used in the invention is not particularly limited and examples thereof include: magnetic metals such as iron, steel, nickel, and cobalt; magnetic oxides such as ferrite and magnetite; and glass beads. Among them, a magnetic material is preferably used in a case where a magnetic brush method is employed for development. A volume average particle diameter of a carrier core is generally in the range of from 10 to 150 μm and preferably in the range of from 20 to 60 μm. A true specific gravity of the core material is generally in the range of from 4 to 6 $g/cm^2$.

A carrier core material can be a spherical core obtained by dispersing magnetic powder in a resin. Since the spherical core has low specific gravity, a stress placed on a toner and a carrier can be suppressed. The combination of the spherical core and the above-mentioned coating resin is further effective for securing the charge retainablity and the charge environmental stability. Examples of resin included in the spherical core include cross-linking resins such as phenol resins and melamine resins and thermoplastic resins such as polyethylene and polymethyl methacrylate.

An average diameter of spherical cores generally has a volume-average particle diameter of from 10 to 150 μm and more preferably has a volume-average particle diamter of 20 to 60 μm. A shape factor SF1 of the spherical core (SF1= $(ML'^2/A')\times(\pi/4)\times100$, wherein ML' represents the maximum length of the spherical core and A' represents the projected area of the spherical core) is preferably 125 or less. A true specific gravity is generally in the range of from 3 to 5 $g/cm^3$ and a saturation magnetization is preferably 40 emu/g or greater.

The shape factor SF1 can be determined similarly to the case of determining SF1 of a toner from maximum lengths and projected areas of more than 100 spherical cores. Such data are obtained by measurement of the optical microscopic images of the spherical cores dispersed on a slide glass plate, which images are captured by a LUZEX image analyzing apparatus through a video camera.

Since resin coating on a carrier core material surfaces insulate the carrier, it becomes difficult for the carrier to work as a developing electrode; therefore, reproducibility of a solid image is degraded, for example, an edge effect occurs especially in a solid black portion. Hence, in order to improve reproducibility of a solid image, a conductive material may be dispersed in a coating resin layer.

Examples of the conductive material used in the invention include: powder of metals such as gold, silver and copper; carbon black; semiconductive oxides such as titanium oxide and zinc oxide; and powders obtained by covering surfaces of powders made of titanium oxide, zinc oxide, barium sulfate, aluminum borate, potassium titanate and the like with tin oxide, carbon black or a metal.

Among them, carbon black is preferable in terms of manufacturing stability, cost and conductivity. No specific limitation is placed on kinds of carbon black and known carbon blacks can be used. Carbon black having a DBP oil absorption in the range of from 50 to 300 ml/100 g, which have excellent manufacturing stability, are particularly preferable.

A carrier after coating has a surface exposure ratio of a core material component of a carrier is preferably small.

This is because a carrier having large surface exposure ratio of a core component may fail to obtain sufficient environmental stability owing to hydrophobicity of the carrier core. In order to obtain sufficient charge environmental stability and charge retainablity, a surface of a core have to be covered with a coating resin of the invention to the highest possible surface coverage ratio.

In the invention, a surface exposure ratio of a core material component of a carrier is preferably in the range of from 0 to 20.0% and more preferably in the range of from 0 to 10.0%.

A surface exposure ratio of a core material component of 0% indicates a state where the entire carrier surface is coated with a resin coat. When the entire carrier surface is covered with a resin coat, the resin coated carrier fulfill functions of a coated carrier. If a surface exposure ratio of a core material component exceeds 20.0%, in some cases, a toner and an external additive are selectively attached onto an exposed surface, thereby greatly reducing a charging ability of the carrier.

The term "a surface exposure ratio of a core material component" used herein means a ratio of a total area of (a) portion(s) on a carrier surface which portion(s) is/are not coated with a resin to the total area of the carrier surface, that is a ratio of an area of (a) portion(s) where a core material is exposed to the total area of the carrier surface. The ratio is calculated from a number ratio of atoms measured by XPS (for example, JPS80 manufactured by JEOL. Ltd.), that is the surface exposure ratio is obtained from a number ratio, measured by XPS, of atoms included in components of a resin coat to atoms included in components of a core material.

In actual measurement, only several kinds of main component elements of a resin coat and only several kinds of main component elements of a core material are measured with XPS. The obtained counts of respective main component elements are summed up in each case of the resin coat or the core material. Each total sum of the counts of the main component elements is used for calculating the surface exposure ratio of the core material component. Alternatively, all the component elements may be measured with XPS. The main component elements of a resin coat may be, for example, C, F, N, Si, O and the like, while the main component elements of a core material may be Fe, Ni, Co, Mn, Cr, O and the like. The main component elements may be selected from all the component elements of a resin coat or a core material (with exception of an element contained in both the resin coat and the core materials, however a so-called trace element may be included even if contained in both) so that a total number proportion of the selected main component elements becomes 90% or higher (preferably 95% or higher). In this selection procedure, component elements are preferably selected in decreasing order of compositional proportions.

Typical methods for forming a coating resin layer are:

an immersion method in which a resin, powder of a quaternary ammonium salt compound, and, if necessary, a conductive material are added to a solvent that can dissolve the resin to form a coating resin layer forming solution and carrier core powder are immersed into the solution;

a spray method in which a coating resin layer forming solution is sprayed on surfaces of core particles;

a fluid membrane method in which a coating resin layer forming solution is sprayed on carrier cores floating on fluid air;

a kneader coater method in which carrier cores are mixed with a coating resin layer forming solution in a kneader coater, then the solvent is removed from the mixture; and the like. However, a method of forming a coating resin layer is not specifically limited to a method using a solution.

No restriction is imposed on a solvent that is used in a raw material solution for forming a coating resin layer and any of solvents can be used as far as the solvents can dissolve the resin. Examples of usable solvent include: aromatic hydrocarbons such as xylene and toluene; ketones such as acetone and methyl ethyl ketone; ethers such as tetrahydrofuran and dioxane; and halides such as chloroform and carbon tetrachloride.

An amount of a coating resin on a carrier in the invention is adequately in the range of from 0.05 to 5.0% by mass relative to a total mass of the carrier in order to balance the image quality, side effect and the charging property.

An average film thickness of a coating resin layer is generally in the range of from 0.1 to 10 μm and, according to the invention, preferably in the range of from 0.5 to 3 μm in order to maintain a stable volume resistivity of a carrier for a long time.

In order to achieve a high image quality, a volume resistivity of a carrier prepared as described above is preferably in the range of from $10^9$ to $10^{13}$ Ωcm under an electric field in the range of from $10^3$ to $10^4$ V/cm, which range is a range of usual development contrast potential. If a volume resistivity of a carrier is smaller than $10^9$ Ωcm, reproducibility of a fine line is poor and toner fog in a background portion easily occurs owing to injection of an electric charge. On the other hand, if a volume resistivity of a carrier is greater than $10^{13}$ Ωcm, reproducibility of a black solid print and a half tone print becomes poor, the amount of the carrier that migrates to a photoreceptor increases, and the photoreceptor is more likely to be hurt.

(Toner)

A toner according to the invention has a shape factor SF1 generally in the range of from 100 to 140. For preparing the toner, a dry-method which comprises pulverization and classification or a wet-method in which a toner is formed in a liquid may be employed. While both of the methods may be employed in the invention, the wet-method is suitable for preparing the spherical toner.

Examples of the wet method include:

an emulsion polymerization coalescence method in which a resin particle dispersion obtained by emulsion polymerizing polymerizable monomers that will form a binding resin, a coloring agent dispersion, a release agent dispersion and, if necessary, a dispersion of a charge controlling agent or the like are mixed to form aggregated particles, then the aggregated particles are heated and melted to coalesce the components in the aggregated particles, whereby toner particles are formed;

a suspension polymerization method in which a solution containing polymerizable monomers that will form a binding resin, a solution of a coloring agent, a solution of a release agent, and, if necessary, a solution of a charge controlling agent or the like, are suspended in an aqueous solvent and the monomers are polymerized to form toner particles; and a dissolution suspension method in which a solution containing a binding resin, a coloring agent, a release agent, and a charge controlling agent or the like if necessary is suspended in an aqueous solvent and the suspension is used for producing toner particles. The emulsion polymerization coalescence method is most preferable.

Examples of the binding resin used in a toner according to the invention include homopolymers and copolymers of:

styrenes such as styrene and chlorostyrene;

monoolefins such as ethylene, propylene, butylene, and isoprene;

vinyl esters such as vinyl acetate, vinyl propionate, vinyl benzoate, and vinyl lactate;

unsaturated carboxylic acids such as (meth)acrylic acid, vinylacetic acid, allylacetic acid, and 10-undecenoic acid;

styrene derivatives each having a carboxyl group such as carboxylstyrene;

α-methylene fatty acid monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacylulate;

vinyl ethers such as vinyl methyl ether, vinyl ethyl ether, and vinyl butyl ether; and vinyl ketones such as vinyl methyl ketone, vinyl hexyl ketone, vinyl isopropenyl ketone.

Especially representative binding resins are polystyrene, styrene-alkyl acrylate copolymers, styrene-alkyl methacrylate copolymers, styrene-acrilonitrile copolymers, styrene-butadiene copolymers, styrene-maleic anhydride copolymers, polyethylene, polypropylene, and the like. Polyester, polyurethane, epoxy resins, silicone resins, polyamides, modified rosins, paraffin waxes and the like are also cited as examples of the resin.

While a carrier coated with a positively charging resin (particles charging a toner negatively) is used in the invention, the ability of the carrier to charge the toner which has a negative polarity decreases in some cases. In such a case, it is effective to improve a negatively charging tendency of the toner and ensure a charging characteristic as a developing agent by using a polymer comprising a monomer having a carboxyl group as a binding resin of a toner. Such a polymer comprising a monomer having a carboxyl group may be a resin that is cited as an example of the carrier coating resin or a resin that can be used as a binding resin of a toner. The polymer comprising a monomer having a carboxyl group may be same as or different from a coating resin on a carrier, and the same effect is obtained as long as the polymer comprises a carboxyl group in each of the cases.

Typical examples of the coloring agent used in a toner include magnetic powder such as magnetite and ferrite, carbon black, Aniline blue, Calco Oil Blue, Chrome Yellow, Ultra Marine Blue, Du Pont Oil Red, Quinoline Yellow, Methylene Blue Chloride, Phthalocyanine Blue, Marachite Green Oxalate, lamp black, Rose Bengal, C. I. Pigment Red 48:1, C. I. Pigment Red 122, C. I. Pigment Red 57:1, C. I. Pigment Yellow 97, C. I. Pigment Yellow 17, C. I. Pigment Yellow 12, C. I. Pigment Yellow 128, C. I. Pigment Yellow 151, C. I. Pigment Yellow 155, C. I. Pigment Yellow 173, C. I. Pigment Yellow 180, C. I. Pigment Yellow 185, C. I. Pigment Yellow 15:1, and C. I. Pigment Yellow 15:3.

Typical examples of release agents used in a toner in the invention include a low molecular polyethylene, low molecular polypropylene, fisher tropsch wax, montan wax, carnauba wax, rice wax, and candelilla wax. A known release agent can also be used.

A charge controlling agent can be added into the toner recited in the invention in accordance with necessity. Known charge controlling agents can be used, and specifically an azo metal complex compound, a metal complex compound of salicylic acid, and a charge controlling agent of a polar-group containing resin type can be used. The charge controlling agent is preferably hard to dissolve into water from the viewpoints of ionic strength control and reduction in pollution by wastewater. A toner recited in the invention may be either a magnetic toner containing a magnetic material or a non-magnetic toner containing no magnetic material.

Particles used in the invention which has a volume resistivity of $1\times10^{14}$ Ωcm or greater and an average primary particle diameter of 50 nm or less can be known particles. Examples thereof include silica particles, alumina particles, magnesia particles, silica-alumina composite particles, and silica-titania composite particles. Silica particles are preferable since they have a negatively charging tendency.

Known surface treatments may be applied on surfaces of the particles in accordance with a purpose. In the invention, a silicone oil treatment capable of comparatively improving the charge environmental stability or a combination of a silicone oil treatment and another surface treatment is preferably conducted. Such another treatment is a known treatment and can be, for example, a silane coupling agent treatment, a fatty acid treatment, or the like. However, a treatment using an agent which includes a nitrogen atom is not preferable because an incorporation of a nitrogen atom into a toner greatly reduces the negatively charging tendency of the toner and the electrification quantity of the toner becomes unable to be increased. Therefore, the treating agent is preferably constituted only of a carbon atom, an oxygen atom, a silicon atom and a hydrogen atom.

Examples of commercially available silica subjected to the silicone oil treatment include: RY200, R202, RY200S, NY50 and RY50 (all being manufactured by Nippon Aerosil Co., Ltd.); and HDKH05TD, HDKH13TD, HDKH20TD and HDKH30TD (all being manufactured by Clariant (Japan) K.K.).

The silicone oil used in the surface treatment described above can be a known silicone oil without any specific limitation. The silicon oil preferably has a kinematic viscosity at 25° C. in the range of from $10\times10^{-6}$ to $1000\times10^{-6}$ $m^2/s$. If the kinematic viscosity is lower than $10\times10^{-6}$ $m^2/s$, the molecular weight of the oil is excessively low and the oil exhibits too high volatility during a heat-treatment. If the kinematic viscosity is higher than $1000\times10^{-6}$ $m^2/s$, since the viscosity is excessively high, an adhering force of particles after a surface treatment is so strong as to form an aggregate of the particles, which deteriorates the toner fluidity and the developing property.

An amount of a surface treatment agent is preferably in the range of from 1 to 30% by mass and more preferably in the range of from 5 to 15% by mass. If the amount is less than 1% by mass, an effect of a surface treatment cannot be sufficiently obtained in some case, while if the amount is more than 30% by mass, an aggregation of particles occurs, which also exerts an bad influence upon the toner fluidity and the developing property of the toner in some case.

In the invention, the particles having a volume resistivity of $1\times10^{14}$ Ωcm or higher and an average primary particle diameter of 50 nm or less are incorporated into toner particles by using a known mixer such as V type blender, Henshel mixer, Ledige mixer or the like.

An amount of the specific particles to be added is preferably in the range of from 0.3 to 5 parts by mass and more preferably in the range of from 0.5 to 3 parts by mass per 100 parts by mass of a toner.

As described above, it is necessary that a total covering ratio of specific particles is higher than a total covering ratio of other kinds of particles on the surface of the toner. As long as such a condition is satisfied, another additive may be added for increasing a total covering ratio of all the particles in accordance with necessity.

Examples of such another additive include cleaning auxiliaries or transfer auxiliaries, such as titania, silica, calcium carbonate, magnesium carbonate, calcium phosphate, cerium oxide, strontium titanate, polystyrene particles, polymethyl methacrylate particles, polyvinylidene fluoride particles, polyethylene particles and the like.

Among them, titania and silica are preferable. A combination of a silica additive which is a specific particle according to the invention and a titania additive and a combination of a silica additive which is a specific particle according to the invention and another silica additive are more preferable from the standpoint of the charge retainability.

A total addition amount of (an) additive(s) other than specific particles is preferably in the range of from 0.1 to 3 parts by mass and more preferably in the range of from 0.2 to 2 parts by mass per 100 parts by mass of a toner.

In the invention, an attachment state of specific particles onto toner particle surfaces may be either simply of mechanical attachment or of loose adhesion to the toner particle surfaces. It is allowed that a toner can be subjected to a sieving process after an external additive is added to the toner.

Toner particles tend to become smaller in diameter as image quality becomes higher. A volume average particle diameter of a toner used in the invention is preferably in the range of from 2 to 12 μm and more preferably in the range of from 5 to 10 μm.

Carrier particles also tend to become smaller in diameter as image quality becomes higher. A ratio of a carrier diameter to a toner diameter (a volume average particle diameter of a carrier/a volume average particle diameter of a toner) in a practical use is preferably in the range of from 2 to 15 and more preferably in the range of from 3 to 10 in order to ensure a wide range of toner densities that enable appropriate development.

<Image Forming Method>

The image forming method according to the invention comprises at least:

a charging step of charging a surface of an electrostatic latent image bearing member;

an electrostatic latent image forming step of forming an electrostatic latent image on the surface of the electrostatic latent image bearing member;

a developing step of transforming the latent image into a toner image by using an electrostatic latent image developing agent;

a transfer step of transferring the toner image formed on the surface of the electrostatic latent image bearing member to a surface of a receiving substrate;

a fixing step of thermally fixing the toner image transferred to the surface of the receiving substrate; and a cleaning step of removing toner remaining on the surface of the electrostatic latent image bearing member, wherein the electrostatic latent image developing agent is the electrostatic latent image developing agent recited in the invention.

The charging step is a step of uniformly charging the surface of an electrostatic latent image bearing member with a charging device. Examples of the charging device include non-contact type chargers such as collontron, scollontron and the like and contact-type chargers charging the surface of the electrostatic latent image bearing member by applying a voltage to a conductive member in contact with the surface of the electrostatic latent image bearing member. However, any charger may be used. It is preferable to use a contact-type charger because a non-contact type charger generate little ozone, is eco-friendly, and has better printing resistance. In a contact-type charger, a shape of a conductive member may be, for example, brush-shape, blade-shape, pin-electrode-shape, roller-shape. Among them, a roller-shaped conductive member is preferable.

The image forming method of the invention has no specific limitation imposed on the charging step.

The electrostatic latent image forming step is a step of exposing an electrostatic latent image bearing member whose surface has been charged uniformly to a radiation from an exposure device such as a laser optical system, a LED array, and the like so as to form a latent image. The image forming method of the invention has no specific limitation imposed on the manner of exposure.

The developing step is a step of bringing a developing agent bearing member which comprises a developing agent layer on a surface thereof into contact with or close to the surface of the electrostatic latent image bearing member so that toner particles are attached to the latent image on the surface of the electrostatic latent image bearing member and a toner image is formed on the electrostatic latent image bearing member. While a known developing method can be adopted, the two-component developing agent that is used in the invention may be a cascade method, a magnetic brush method, and the like.

In the case of the magnetic brush method, a magnetic sleeve is used as the developing agent bearing member. A magnetic sleeve used in the invention can be a known magnetic sleeve and no restriction is imposed regarding a material, a magnetic force, and the like a surface roughness of a sleeve is preferably so minute that the ten point average roughness Rz is in the range of from 15 to 25 μm, the centre line average roughness Ra is in the range of from 1 to 5 μm in order to ensure the transport stability of a developing agent, to suppress scattering of a carrier and to form an excellent image having no defects. A generally used sleeve has Rz of 10 μm or less. However, when at least one of a carrier having a small diameter, a carrier having a small shape factor SF1 (a carrier having a shape factor SF1 which is less than 125), a toner having a small particle diameter, and a toner having a small shape factor SF1 (a toner having a shape factor SF1 which is less than 140) is used in a developing agent, transportation of the developing agent tends to become unstable. If such a developing agent is used, it is effective to use a magnetic sleeve that satisfies the above-mentioned conditions for displaying the characteristics of the developing agent fully.

The transfer step is a step of transferring the toner image formed on the surface of the electrostatic latent image bearing member to a receiving substrate to form a transfer image. In a case of forming full color image, it is preferable that toners in respective colors should be primarily transferred to an intermediate transfer drum or an intermediate transfer belt as an intermediate transfer member (a receiving member), then secondarily transferred to a receiving substrate such as paper. It is preferable that toner images in respective colors should be temporarily transferred onto an intermediate transfer member, all the color toner images in colors are transferred to a receiving substrate at one time.

Collontron can be used as a transfer apparatus transferring a toner image from a photoreceptor to paper or an intermediate transfer member. While Collontron is effective as a means for charging paper uniformly, a voltage as high as several kV has to be applied in order to impart a predetermined charge to paper, which is a receiving substrate, and a high voltage power supply is required. Because ozone is generated by corona discharge, a member made of rubber and a photoreceptor are degraded. Therefore, it is preferable to employ a contact transfer method in which toner image is transferred to paper by pressing a conductive transfer roll which is made of an elastic material against the electrostatic latent image bearing member.

In an image forming method of the invention, no specific limitation is imposed on a transfer apparatus.

The fixing step is a step of fixing the toner image transferred onto the surface of the receiving substrate with a fixing apparatus. As a fixing apparatus, it is preferable to use a thermal fixing apparatus using a heat roll. The thermal fixing apparatus consists of, for example: a fixing roller comprising a heater lamp inside of a cylindrical core metal and a heat-resistant resin coating layer or a heat-resistant rubber coating layer as a releasing layer; and a pressure roller or a pressure belt each of which is pressed against the fixing roller and consists of a cylindrical core metal or a belt-like substrate and a heat-resistant elastic layer provided on the cylindrical core metal or the belt-like substrate. The receiving substrate having unfixed image thereon is passed between the fixing roller and the pressure roller or the pressure belt to melt the binding resin or an additive in the toner, whereby the unfixed image is fixed.

In the image forming method of the invention, no specific limitation is imposed on a manner of fixing.

The cleaning step is a step of removing toner remaining on the surface of the electrostatic latent image bearing member after the transfer step. As a cleaning method, a blade cleaning method has generally been used so far because of stability of performance thereof. However, in the electrostatic latent image developing agent according to the invention, owing to the use of the electrostatic latent image developing agent recited in the invention, it is possible to recover the residual toner on the surface of the electrostatic latent image bearing member by using an electrostatic brush. Accordingly, a wear life of the latent image bearing member is greatly extended according to the invention.

A conductive brush, which is a fibrous material made of a resin that contains a conductive filler made of, for example, carbon black, a metal oxide or the like or is a fibrous material obtained by coating a fiber with such a conductive filler, can be used as the electrostatic brush. However, the electrostatic brush usable in the invention is not limited to such a conductive brush. As an example, the cleaning can be conducted by using an electrostatic brush to which a voltage is applied.

In the image forming method according to the invention, which comprises the above-mentioned steps and uses the electrostatic latent image developing agent of the invention containing the toner and the carrier described above, it is possible to form image while suppressing the charge environmental dependency and retaining a good charging property.

Furthermore, by using the specific toner together with the specific carrier described above, transferability can be improved in addition to the improvement of the characteristics, and high-quality image can be formed thereby.

EXAMPLES

While specific description will be given of the present invention by using examples, the invention is by no means limited to the examples. Note that in description of a toner and a carrier, "part" means "part by mass" unless expressly defined otherwise.

First, description is presented about toners, carriers and developing agents used in examples and comparative examples.

<Measuring Method>

In preparing the following toners, carriers and developing agents, respective characteristic values are measured according to the following manner.

(Measurement of Volume Resistivity of External Additive and Carrier)

As shown in FIG. 1, while a specimen 3 was sandwiched between a lower electrode 4 and an upper electrode 2 and pressed from above, a thickness L was measured with a dial gauge and an electric resistance of the specimen 3 was measured with a high voltage ohmmeter 6.

To be specific, in both cases of an external additive and a carrier, a specimen 3 was placed on the lower electrode 4 having a diameter of 100 mm, a specimen holding ring 5 was provided around the specimen, the upper electrode 2 and a ground electrode 1 were placed on the specimen 3, and a load of 3.43 kg was applied to the specimen from above to measure a thickness L with the dial gauge. Then a voltage was applied and a current value was read to obtain a volume resistivity.

The volume resistivity (Ω·cm) was calculated according to the following formula:

$$R=\alpha\times E/(I-I_0)/L$$

wherein in the formula, R represents a volume resistivity (Ω·cm), E represents an applied voltage (V), I represents a current value (A), $I_0$ represents a current value at an applied voltage of 0 V, L represents a thickness of a specimen layer (mm), and a coefficient a represents an area ($cm^2$) of an electrode plate.

(Average Particle Diameter of External Additive)

An average primary particle diameter of particles of an external additive was measured in a manner in which the particles of the external additive were dispersed on a metal mesh by being sprinkled on the metal mesh and projected areas were measured by using an image analyzing apparatus (with a trade name of LUZEX III manufactured by Nireco Corporation).

(Shape Factor SF1 of Toner (or Carrier))

In the invention, a surface factor SF1 of a toner (or a carrier) means the average of the values of the respective toner (or carrier) particles which values are obtained according to the following formula:

$$SF1=(ML^2/A)\times(\pi/4)\times 100$$

wherein in the formula, ML represents the maximum length of a toner particle (or the carrier particle) and A represents a projected area of the toner particle or the carrier particle. In a case of a perfect sphere, a shape factor SF1 is 100.

Specifically, images of respective toner (or carrier) particles were captured by an image analyzing apparatus (with a trade name of LUZEX III manufactured by Nireco Corporation) by using an optical microscope. Then, sphere-corresponding diameter of the respective particles were measured and SF1 of the respective particles were determined from maximum lengths and areas of the respective particles according to the formula.

(Measurement of Toner Charge Quantity)

A toner charge quantity in an practical evaluation test described later was measured in a manner in which about 0.4 g of a developing agent on a magsleeve in a developer was sampled to measure a charge quantity thereof with TB200 manufactured by TOSHIBA CORP. under conditions of 25°

C. and a humidity 55% R.H. Toner concentration in a developing agent was about 5% by mass in every case.

(Surface Exposure Ratio of Carrier Core Material Component)

A surface exposure ratio of a carrier core material component means a value calculated according to the following formula:

(a surface exposure ratio of a carrier core component)=(an atom-number proportion, after coating, of the elements coming from the core)/(an atom-number proportion, before coating, of the elements coming from the core)×100% wherein a core obtained by removing a resin which forms the surface of the carrier may be regarded as the core before resin coasting recited in the formula. Each parameters in the formula is obtained by measuring, before coating or after coating, the surface of the carrier with an element analyzer XPS. By this measurement, relative change of a proportion of the elements coming from the core is clarified.

<Preparation of High Resistivity Particles>

Preparation of Particles (A)

Silica particles A130 (having an average particle diameter of 16 nm, manufactured by Nippon Aerosil Co., Ltd.) were dispersed into a toluene solution and dimethyl silicone oil KF96 (having a kinematic viscosity of $200\times10^{-6}$ $m^2/s$, manufactured by Shin-Etsu Chemical Co., Ltd.) were added into the dispersion. The mixture was treated with ultrasonic wave. Then, toluene was distilled off from the mixture by an evaporator. After the mixture was heated at 150° C. for 1 hr, the mixture was pulverized to obtain particles (A), which was silicone-treated silica particles having an average primary particle diameter of 18 nm. The volume resistivity of the particles (A) was $10^{15}$ Ω·cm or greater when an electric field of 1000 V/cm is applied thereto.

Preparation of Particles (B)

Particles (B), which were silicone-treated silica particles having an average primary particle diameter of 14 nm, were obtained in the same manner as that in the case of the particle (A) except that silica particles A200 (having an average primary particle diameter of 12 nm, manufactured by Nippon Aerosil Co., Ltd.) were used in place of the silica particles A130 used in the preparation of the particles (A). The volume resistivity of the particles (B) was $10^{15}$ Ω·cm or greater when an electric field of 1000 V/cm is applied thereto.

<Preparation of Carrier>

Preparation of Carrier I 1.0 part of a styrene-acrylic resin (stryrene/methyl methacrylate=20/80; Mw=43000) and 0.5 part of a quaternary ammonium salt compound (with a trade name of P51 manufactured by Orient Chemical Industries Ltd) were added into 14 parts of toluene. The mixture was agitated and dispersed by a sand-mill to prepare a coating resin layer forming solution. The solution and 100 parts of ferrite particles (made of Mn—Mg ferrite, having a true specific gravity of 4.7 $g/cm^3$, a volume average particle diameter of 35 μm, a saturation magnetization of 66 emu/g and a shape factor (SF1) of 118) were put into a vacuum deaeration kneader. Then, this mixture was agitated for 10 min at a constant temperature of 60° C., and thereafter toluene was distilled off under a reduced pressure to form a coating resin layer on the surfaces of the ferrite particles. Then the particles were sieved with a net having a mesh size of 75 μm to obtain a carrier I.

The volume resistivity of the carrier I was $1\times10^{12}$ Ω·cm and the surface exposure ratio of the core material component was 20%.

Preparation of Carrier II 1.0 part of a polymethyl methacrylate resin (Mw: 43000) and 0.2 part of a quaternary ammonium salt compound (with a trade name of P51 manufactured by Orient Chemical Industries Ltd) were added into 14 parts of toluene. The mixture was agitated and dispersed by a sand-mill to prepare a coating resin layer forming solution. The solution and 100 parts of ferrite particles (made of Mn—Mg ferrite, having a true specific gravity of 4.7 $g/cm^3$, a volume average particle diameter of 40 μm, a saturation magnetization of 68 emu/g and a shape factor (SF1) of 120) were put into a vacuum deaeration kneader. Then, this mixture was agitated for 10 min at a constant temperature of 60° C., and thereafter toluene was distilled off under a reduced pressure to form a coating resin layer on the surfaces of the ferrite particles. Then the particles were sieved with a net having a mesh size of 75 μm to obtain a carrier II.

The volume resistivity of the carrier II was $1\times10^{13}$ Ω·cm and the surface exposure ratio of the core material component was 15%.

Preparation of Carrier III

A carrier III was obtained in the same manner as in the case of the carrier I except that, styrene/methyl methacrylate/vinylpyrrolidone (in the ratio of 20/78/2) copolymer resin (Mw: 45,000) was used in place of the styrene-acrylic resin used in the preparation of the carrier I.

The volume resistivity of the carrier III was $1\times10^{12}$ Ω·cm and the surface exposure ratio of the core material component was 18%.

Preparation of Carrier IV 1.5 parts of a fluororesin (methyl methacrylate/perfluorooctylethyl methacrylate=95/5; Mw=51,000), 0.08 part of a carbon black (with a trade name of VXC-72 manufactured by Cabot Corporation), and 0.4 part of a quaternary ammonium salt compound (with a trade name of P51 manufactured by Orient Chemical Industries Ltd) were added into 14 parts of toluene. The mixture was agitated and dispersed by a sand-mill to prepare a coating resin layer forming solution. The solution and 100 parts of ferrite particles (made of Mn—Mg ferrite, having a true specific gravity of 4.7 $g/cm^3$, a volume average particle diameter of 40 μm, a saturation magnetization of 68 emu/g and a shape factor (SF1) of 120) were put into a vacuum deaeration kneader. Then, this mixture was agitated for 10 min at a constant temperature of 60° C., and thereafter toluene was distilled off under a reduced pressure to form a coating resin layer on the surfaces of the ferrite particles. Then the particles were sieved with a net having a mesh size of 75 μm to obtain a carrier IV.

The volume resistivity of the carrier IV was $1\times10^{11}$ Ω·cm and the surface exposure ratio of the core material component was 5%.

Preparation of Carrier V 1.6 parts of a styrene-acrylic resin (styrene/methyl methacrylate=50/50, Mw: 53,000), 0.12 part of a carbon black (with a trade name of VXC-72 manufactured by Cabot Corporation), and 0.2 part of a quaternary ammonium salt compound (with a trade name of P51 manufactured by Orient Chemical Industries Ltd) were added into 14 parts of toluene. The mixture was agitated and dispersed by a sand-mill to prepare a coating resin layer forming solution.

The solution and 100 parts of ferrite particles (made of Mn—Mg ferrite, having a true specific gravity of 4.7 g/cm$^3$, a volume average particle diameter of 35 μm, a saturation magnetization of 67 emu/g and a shape factor (SF1) of 117) were put into a vacuum deaeration kneader. Then, this mixture was agitated for 10 min at a constant temperature of 60° C., and thereafter toluene was distilled off under a reduced pressure to form a coating resin layer on the surfaces of the ferrite particles. Then the particles were sieved with a net having a mesh size of 75 μm to obtain a carrier V.

The volume resistivity of the carrier V was $1\times10^9$ Ω·cm and the surface exposure ratio of the core material component was 10%.

Preparation of Carrier VI

A carrier VI was obtained in the same manner as in the case of the carrier I except that the quaternary ammonium salt compound used in the preparation of the carrier I as a component of the coating resin layer was not used.

The volume resistivity of the carrier VI was $1\times10^{13}$ Ω·cm and the surface exposure ratio of the core material component was 18%.

Preparation of Carrier VII 1.3 parts of a silicone resin (with a trade name of SR2411 manufactured by Toray Dow Corning Silicone Ltd.) and 0.2 part of a quaternary ammonium salt compound (with a trade name of P51 manufactured by Orient Chemical Industries Ltd) were added into 14 parts of toluene. The mixture was agitated and dispersed by a sand-mill to prepare a coating resin layer forming solution. The solution and 100 parts of ferrite particles (made of Mn—Mg ferrite, having a true specific gravity of 4.7 g/cm$^3$, a volume average particle diameter of 40 μm, a saturation magnetization of 67 emu/g and a shape factor (SF1) of 117) were put into a vacuum deaeration kneader. Then, this mixture was agitated for 10 min at a constant temperature of 60° C., and thereafter toluene was distilled off under a reduced pressure to form a coating resin layer on the surfaces of the ferrite particles. Then the particles were sieved with a net having a mesh size of 75 μm to obtain a carrier VII. The silicone resin did not show the characteristics of the positively charging resin recited in the invention.

The volume resistivity of the carrier VII was $1\times10^{13}$ Ω·cm and the surface exposure ratio of the core material component was 10%.

Preparation of Carrier VIII 2.0 parts of a fluororesin (methyl methacrylate/perfluorooctylethyl methacrylate=85/15, Mw: 47,000), 0.12 part of a carbon black (with a trade name of VXC-72 manufactured by Cabot Corporation), and 0.2 part of a quaternary ammonium salt compound (with a trade name of P51 manufactured by Orient Chemical Industries Ltd) were added into 14 parts of toluene. The mixture was agitated and dispersed by a sand-mill to prepare a coating resin layer forming solution. The solution and 100 parts of ferrite particles (made of Mn—Mg ferrite, having a true specific gravity of 4.7 g/cm$^3$, a volume average particle diameter of 40 μm, a saturation magnetization of 67 emu/g and a shape factor (SF1) of 117) were put into a vacuum deaeration kneader. Then, this mixture was agitated for 10 min at a constant temperature of 60° C., and thereafter toluene was distilled off under a reduced pressure to form a coating resin layer on the surfaces of the ferrite particles. Then the particles were sieved with a net having a mesh size of 75 μm to obtain a carrier VIII. The fluororesin did not show the characteristics of the positively charging resin recited in the invention.

The volume resistivity of the carrier VIII was $1\times10^{10}$ Ω·cm and the surface exposure ratio of the core material component was 12%.

Preparation of Carrier IX 2.2 parts of a styrene-acrylic resin (styrene/methyl methacrylate=70/30, Mw: 43,000), 0.14 part of a carbon black (with a trade name of VXC-72 manufactured by Cabot Corporation), and 0.2 part of a quaternary ammonium salt compound (with a trade name of P51 manufactured by Orient Chemical Industries Ltd) were added into 14 parts of toluene. The mixture was agitated and dispersed by a sand-mill to prepare a coating resin layer forming solution. The solution and 100 parts of ferrite particles (made of Mn—Mg ferrite, having a true specific gravity of 4.7 g/cm$^3$, a volume average particle diameter of 40 μm, a saturation magnetization of 67 emu/g and a shape factor (SF1) of 117) were put into a vacuum deaeration kneader. Then, this mixture was agitated for 10 min at a constant temperature of 60° C., and thereafter toluene was distilled off under a reduced pressure to form a coating resin layer on the surfaces of the ferrite particles. Then the particles were sieved with a net having a mesh size of 75 μm to obtain a carrier IX. The styrene-acrylic resin did not show the characteristics of the positively charging resin recited in the invention.

The volume resistivity of the carrier IX was $1\times10^{10}$ Ω·cm and the surface exposure ratio of the core material component was 5%.

<Preparation of Toner>

(Preparation of Toner Particles A)

The mixture of 100 parts of a styrene-n-butyl acrylate resin (Tg: 58° C., Mn: 5,000, Mw: 25,000) and 3 parts of a carbon black (with a trade name of MOGUL L manufactured by Cabot Corporation) was kneaded with an extruder, pulverized with a jet mill, then classified with a pneumatic classifier to obtain toner particles A (black) having a volume average particle diameter D50 of 5.3 μm and a shape factor SF1 of 145.5.

(Preparation of Toner Particles B)

Preparation of Resin Dispersion (1)

370 parts of styrene, 30 parts of n-butyl acrylate, 8 parts of acrylic acid, 24 parts of dodecanethiol, and 4 parts of carbon tetrabromide were mixed to form a solution. The solution was emulsified, in a flask, in a solution obtained by dissolving 6 parts of a nonionic surfactant (with a trade name of NONIPOL 400 manufactured by Sanyo Chemical Industries Ltd.) and 10 parts of an anionic surfactant (with a trade name of NEOGEN SC manufactured by Dai-ich Kogyo Seiyaku Co., Ltd.) into 550 parts of ion-exchanged water. Then, a solution obtained by dissolving 4 parts of ammonium persulfate into 50 parts of ion-exchanged water was added to the emulsion while the emulsion was slowly agitated for 10 minutes. After substituting the air in the flask with nitrogen, the mixture in the flask were heated to 70° C. by using an oil bath while being agitated, and the mixture was kept in this state for 5 hours, during which emulsion polymerization proceeded. As a result, a resin dispersion (1) was obtained in which particles of the resin having an average particle diameter of 155 nm, Tg of 59° C. and a weight-average molecular weight Mw of 1,000 were dispersed.

Preparation of Resin Dispersion (2)

280 parts of styrene, 120 parts of n-butyl acrylate, and 8 parts of acrylic acid were mixed to form a solution. The solution was emulsified, in a flask, in a solution obtained by dissolving 6 parts of a nonionic surfactant (with a trade name of NONIPOL 400 manufactured by Sanyo Chemical Industries Ltd.) and 12 parts of an anionic surfactant (with a trade name of NEOGEN SC manufactured by Dai-ich Kogyo Seiyaku Co., Ltd.) into 550 parts of ion-exchanged water. Then, a solution obtained by dissolving 3 parts of ammonium persulfate into 50 parts of ion-exchanged water was added to the emulsion while the emulsion was slowly agitated for 10 minutes. After substituting the air in the flask with nitrogen, the mixture in the flask were heated to 70° C. by using an oil bath while being agitated, and the mixture was kept in this state for 5 hours, during which emulsion polymerization proceeded. As a result, a resin dispersion (2) was obtained in which particles of the resin having an average particle diameter of 110 nm, Tg of 53° C. and a weight-average molecular weight Mw of 550,000 were dispersed.

Preparation of Coloring Agent Dispersion (1)

50 parts of a carbon black (with a trade name MOGUL L manufactured Cabot Corporation), 5 parts of a nonionic surfactant (with a trade name of NONIPOL 400 manufactured by Sanyo Chemical Industries Ltd.), and 200 parts of ion-exchanged water were mixed to form a solution. The solution was dispersed by using a homogenizer (with a trade name of ULTRA-TURRAX T-50 manufactured by IKA Co.) for 10 min to prepare a coloring agent dispersion (1) containing dispersed particles of the coloring agent (the carbon black) having a diameter of 250 nm.

Preparation of Coloring Agent Dispersion (2)

70 parts of a cyan pigment (C.I. Pigment Blue 15:3), 5 parts of a nonionic surfactant (with a trade name of NONIPOL 400 manufactured by Sanyo Chemical Industries Ltd.), and 200 parts of ion-exchanged water were mixed to form a solution. The solution was dispersed by using a homogenizer (with a trade name of ULTRA-TURRAX T-50 manufactured by IKA Co.) for 10 min to prepare a coloring agent dispersion (2) containing dispersed particles of the coloring agent (the cyan pigment) having a diameter of 250 nm.

Preparation of Coloring Agent Dispersion (3)

70 parts of a magenta pigment (C.I. Pigment Red 122), 5 parts of a nonionic surfactant (with a trade name of NONIPOL 400 manufactured by Sanyo Chemical Industries Ltd.), and 200 parts of ion-exchanged water were mixed to form a solution. The solution was dispersed by using a homogenizer (with a trade name of ULTRA-TURRAX T-50 manufactured by IKA Co.) for 10 min to prepare a coloring agent dispersion (3) containing dispersed particles of the coloring agent (the magenta pigment) having a diameter of 250 nm.

Preparation of Coloring Agent Dispersion (4)

100 parts of a yellow pigment (C.I. Pigment Yellow 180), 5 parts of a nonionic surfactant (with a trade name of NONIPOL 400 manufactured by Sanyo Chemical Industries Ltd.), and 200 parts of ion-exchanged water were mixed to form a solution. The solution was dispersed by using a homogenizer (with a trade name of ULTRA-TURRAX T-50 manufactured by IKA Co.) for 10 min to prepare a coloring agent dispersion (4) containing dispersed particles of the coloring agent (the yellow pigment) having a diameter of 250 nm.

Preparation of Release Agent Dispersion 50 parts of a paraffin wax (with a trade name of HNP 0190 manufactured by Nippon Seiro Co., Ltd.) and 5 parts of a cationic surfactant (with a trade name of SANISOL B50 manufactured by Kao Corporation), and 200 parts of ion-exchanged water were mixed to form a dispersion, in a round stainless steel flask, by using a homogenizer (with a trade name of ULTRA-TURRAX T-50 manufactured by IKA Co.) for 10 min. Thereafter, the dispersion was further dispersed by using a pressure discharge homogenizer to prepare a release agent dispersion containing dispersed release agent particles having an average particle size of 550 nm.

Preparation of Aggregated Particles 120 parts of the Resin dispersion (1), 80 parts of the Resin dispersion (2), 200 parts of the Coloring agent dispersion (1), 40 parts of the Release agent dispersion, and 1.5 parts of a cationic surfactant (with a trade name of SANISOL B50 manufactured by Kao Corporation) were mixed in a round stainless steel flask by using a homogenizer (with a trade name of ULTRA-TURRAX T-50 manufactured by IKA Co.) to form a dispersion. Thereafter, the dispersion in the flask was heated to 50° C. by using an oil bath while being agitated. After the dispersion was kept at 45° C. for 20 min, formation of aggregated particles having an average particle diameter of about 4.3 μm was confirmed by an observation with an optical microscope. 60 parts of the resin dispersion (1) were slowly added to the above dispersion. Then, the temperature of the oil bath was raised up to 50° C. and kept at the temperature for 30 min. By an observation with an optical microscope, it was confirmed that coated particles having an average particle diameter of about 4.6 μm were formed.

3 parts of an anionic surfactant (with a trade name of NEOGEN SC manufactured by Dai-ich Kogyo Seiyaku Co., Ltd.), was added to the dispersion. Thereafter, the stainless steel flask was tightly closed. The dispersion in the flask was heated to 105° C. while being agitated by a magnetic force seal (magnetic drive impeller) and maintained in this state for 4 hr. After cooling the dispersion, the reaction product was filtered out, sufficiently washed with ion-exchanged water, then dried to obtain toner particles B (black).

The shape factor SF1 of the toner particles was 130.5 and the volume average particle diameter D50 thereof was 5.8 μm.

(Preparation of Toner Particle C)

Toner particles C (cyan) were obtained in the same manner as in the case of the toner particles B except that the coloring agent dispersion (2) was used instead of the coloring agent dispersion (1) used in the preparation of the toner particles B.

The shape factor SF1 of the toner particles C was 127.5 and the volume average particle diameter D50 of the toner particles C was 5.9 μm.

(Preparation of Toner Particle D)

Toner particles D (magenta) were obtained in the same manner as in the case of the toner particles B except that the coloring agent dispersion (3) was used instead of the coloring agent dispersion (1) used in the preparation of the toner particles B.

The shape factor SF1 of the toner particles D was 130.2 and the volume average particle diameter D50 of the toner particles D was 5.6 μm.

(Preparation of Toner Particle E)

Toner particles E (yellow) were obtained in the same manner as in the case of the toner particles B except that the coloring agent dispersion (4) was used instead of the coloring agent dispersion (1) used in the preparation of the toner particles B.

The shape factor SF1 of the toner particles E was 128.5 and the volume average particle diameter D50 of the toner particles E was 5.9 μm.

Example 1

1 part of the particles (A) and 1.3 parts of hydrophobic silica RX50 having an average primary particle diameter of 40 nm (with a volume resistivity of $10^{15}$ Ω·cm or greater at an applied electric field of 1000 V/cm, manufactured by Nippon Aerosil Co., Ltd.) were added to 100 parts of each of the toner particles B, C, D, and E. The mixture was mixed by using a Henshel mixer at a peripheral speed of 32 m/sec for 10 min. Thereafter coarse particles were removed by a sieve having a mesh size of 45 μm, and a toner was obtained thereby. The surface covering ratio of the particles (A) was in the range of from 42 to 45%, and the surface covering ratio of the hydrophobic silica RX 50 was in the range of from 25 to 26%.

100 parts of the carrier I and 5 parts of each of the toner were mixed and the mixture was agitated with a V-blender at 40 rpm for 20 min. Then, the mixture was sieved with a sieve having a mesh size of 177 μm to obtain the developing agent (1), which was a set consists of developing agents for 4 colors.

Example 2

1 part of the particles (B) and 1.2 parts of hydrophobic silica RX50 having an average primary particle diameter of 40 nm (with a volume resistivity of $10^{15}$ Ω·cm or greater at an applied electric field of 1000 V/cm, manufactured by Nippon Aerosil Co., Ltd.) were added to 100 parts of the toner particles B. The mixture was mixed by using a Henshel mixer at a peripheral speed of 32 m/sec for 10 min. Thereafter coarse particles were removed by a sieve having a mesh size of 45 μm to obtain a toner. The surface covering ratio of the particles (B) was 58%, and the surface covering ratio of the hydrophobic silica RX 50 was 24%.

100 parts of the carrier II and 5 parts of the toner were mixed and agitated with a V-blender at 40 rpm for 20 min. Then, the mixture was sieved with a sieve having a mesh size of 177 μm to obtain the developing agent (2).

Example 3

1 part of a silicone-treated silica RY200 (an average primary particle diameter: 12 nm, volume resistivity: $10^{15}$ Ω·cm or greater at an applied electric field of 1000 V/cm, manufactured by Nippon Aerosil Co., Ltd.) and 1.2 parts of hydrophobic silica RY50 having an average primary particle diameter of 50 nm (with a volume resistivity of $10^{15}$ Ω·cm or greater at an applied electric field of 1000 V/cm, manufactured by Nippon Aerosil Co., Ltd.) were added to 100 parts of the toner particles B. The mixture was mixed by using a Henshel mixer at a peripheral speed of 32 m/sec for 10 min. Thereafter coarse particles were removed by a sieve having a mesh size of 45 μm to obtain a toner. The surface covering ratio of the silicone-treated silica RY200 was 68%, and the surface covering ratio of the hydrophobic silica RY50 was 19%.

100 parts of the carrier III and 5 parts of the toner were mixed and agitated with a V-blender at 40 rpm for 20 min. Then, the mixture was sieved with a sieve having a mesh size of 177 μm to obtain the developing agent (3).

Example 4

A developing agent (4) was prepared in the same manner as Example 3 except that the carrier IV was used instead of the carrier III used in Example 3.

Example 5

1 part of a silicone-treated silica RY200 (an average primary particle diameter: 12 nm, volume resistivity: $10^{15}$ Ω·cm or greater at an applied electric field of 1000 V/cm, manufactured by Nippon Aerosil Co., Ltd.), 1.2 parts of hydrophobic silica RY50 having an average primary particle diameter of 50 nm (with a volume resistivity of $10^{15}$ Ω·cm or greater at an applied electric field of 1000 V/cm, manufactured by Nippon Aerosil Co., Ltd.), and 0.3 part of cerium oxide particles having an average primary particle diameter of 0.65 μm (with a volume resistivity of $10^{8}$ Ω·cm at an applied electric field of 1000 V/cm) were added to 100 parts of the toner particles B. The mixture was mixed by using a Henshel mixer at a peripheral speed of 32 m/sec for 10 min. Thereafter coarse particles were removed by a sieve having a mesh size of 45 μm to obtain a toner. The surface covering ratio of the silicone-treated silica RY200 was 68%, the surface covering ratio of the hydrophobic silica RY50 was 19%, and the surface covering ratio on the cerium oxide particles was 0.4%.

100 parts of the carrier V and 5 parts of the toner were mixed and agitated with a V-blender at 40 rpm for 20 min. Then, the mixture was sieved with a sieve having a mesh size of 177 μm to obtain the developing agent (5).

Comparative Example 1

1 part of a silicone-treated silica RY200 (an average primary particle diameter: 12 nm, volume resistivity: $10^{15}$ Ω·cm or greater at an applied electric field of 1000 V/cm, manufactured by Nippon Aerosil Co., Ltd.) and 1.2 parts of hydrophobic silica RY50 having an average primary particle diameter of 50 nm (with a volume resistivity of $10^{15}$ Ω·cm or greater at an applied electric field of 1000 V/cm, manufactured by Nippon Aerosil Co., Ltd.) were added to 100 parts of the toner particles A. The mixture was mixed by using a Henshel mixer at a peripheral speed of 32 m/sec for 10 min. Thereafter coarse particles were removed by a sieve having a mesh size of 45 μm to obtain a toner. The surface covering ratio of the silicone-treated silica RY200 was 61%, and the surface covering ratio of the hydrophobic silica RY50 was 18%.

100 parts of the carrier V and 5 parts of the toner were mixed and agitated with a V-blender at 40 rpm for 20 min. Then, the mixture was sieved with a sieve having a mesh size of 177 μm to obtain the developing agent (6).

Comparative Example 2

A developing agent (7) was prepared in the same manner as Example 4 except that the carrier VI was used instead of the carrier IV used in Example 4.

Comparative Example 3

A developing agent (8) was prepared in the same manner as Example 4 except that the carrier VII was used instead of the carrier IV used in Example 4.

Comparative Example 4

A developing agent (9) was prepared in the same manner as Example 4 except that the carrier VIII was used instead of the carrier IV used in Example 4.

Comparative Example 5

A developing agent (10) was prepared in the same manner as Example 4 except that the carrier IX was used instead of the carrier IV used in Example 4.

Comparative Example 6

1.3 part of a decyl silane-treated titania having an average primary particle diameter of 20 nm (with a volume resistivity of $10^{13}$ Ω·cm or higher under an applied electric field of 1000 V/cm) and 1.0 parts of hydrophobic silica RY50 having an average primary particle diameter of 50 nm (with a volume resistivity of $10^{15}$ Ω·cm or greater at an applied electric field of 1000 V/cm, manufactured by Nippon Aerosil Co., Ltd.) were added to 100 parts of the toner particles B. The mixture was mixed by using a Henshel mixer at a peripheral speed of 32 m/sec for 10 min. Thereafter coarse particles were removed by a sieve having a mesh size of 45 μm to obtain a toner. The surface covering ratio of the decyl silane-treated titania was 27%, and the surface covering ratio of the hydrophobic silica was 16%.

100 parts of the carrier VI and 5 parts of the toner were mixed and agitated with a V-blender at 40 rpm for 20 min. Then, the mixture was sieved with a sieve having a mesh size of 177 μm to obtain the developing agent (11).

<Practical Evaluation Test>

The developing agents were set in the developing units of DOCU CENTRE COLOR 500 manufactured by Fuji Xerox Co., Ltd. Long-term use tests were conducted under in a high temperature and high humidity environment (30° C. and 90% R.H.) and in a low temperature and low humidity environment (5° C. and 10% R.H.). In the test, image quality was evaluated regarding such as a change in toner charge quantity, fog, and a solid image density.

Docu Centre Color 500, which was used for the test, is an image forming apparatus comprising: an electrostatic latent image bearing member; a charging means which charges a surface of the electrostatic latent image bearing member; an electrostatic latent image forming means which forms a latent image on the surface of the electrostatic latent image bearing member; a developing unit which contains developing agents each composed of a toner and a carrier and develops the electrostatic latent image by using a layer of each of the developing agents formed on a surface of a developing agent bearing member to form a toner image on the surface of the electrostatic latent image bearing member; a transfer means which transfers the toner image to an intermediate transfer member; and a cleaning-blade-type cleaning means.

Each developing agent was evaluated by being used in the developing unit which was the same as the standard developing unit of Docu Centre Color 500 manufactured by Fuji Xerox Co., Ltd. except the use of a magnetic sleeve having a surface with fine projections and depressions having Rz of 20 μm and Ra of 3 μm.

The following evaluation criteria were employed for evaluating respective items.

(Toner Charge Quantity)

With respect to an initial charge quantity, samples were evaluated by a difference in initial charge quantity between a high temperature and high humidity environment and a low temperature and high humidity environment. Samples which showed the difference which was less than 3 μC/g was judged as A, samples which showed the difference which was in the range of from 3 to 7 μC/g was judged as B, and samples which showed the difference more than 7 μC/g was judged as C.

With respect to charge retainability, each sample was judged as follows. An absolute value of a difference between an initial charge quantity and a charge quantity when 40,000 sheets had been printed under the same environment as the initial environment was measured. Such an absolute value was determined in each of the high temperature and high humidity environment and the low temperature and low humidity environment. The larger value of the obtained absolute values determined in the two different environments was used for evaluation. If the value was less than 3 μC/g, the sample was judged as A. If the value was in the range of from 0.3 to 7 μC/g, the sample was judged as B. And if the value was more than 7 μC/g, the sample was judged as C.

(Image Quality)

A chart image was printed by using each of developing agent samples. Each sample was evaluated by fog and a solid image density of initially printed sheet or of the sheet printed just after 40,000 sheets had been printed. Fog on paper and a solid image density were visually evaluated according to the following evaluation criteria.

Fog on Paper

Fog in a non-image portion of a printed image is sensually evaluated with the naked eye and judged according to the following criteria:

A . . . No fog is observed.

B . . . Fog occurs, however the fog is only slight and is allowable.

C . . . Fog is so severe that a boundary between a non-developed region (margin) and a non-image portion is clearly recognized.

Solid Image Density

An image density was evaluated by using X-Rite 404A (manufactured by X-Rite Co.) and judged according to the following criteria:

A . . . An image density is 1.4 or higher.

B . . . An image density is lower than 1.4

Regarding Comparative Examples 3 to 5 (developing agents (8) to (10)), since a toner charge quantity at an initial stage was low and severe fog developed on the printed papers, initially printed sheet alone was evaluated.

The results of the evaluation of characteristics of the examples and comparative examples are collectively shown in Tables 1 and 2.

TABLE 1

| | | Toner | | | Carrier | | |
|---|---|---|---|---|---|---|---|
| | Developing agent No. | Toner particle | Shape factor | Type of particles having maximum covering ratio | Carrier | Volume resistivity (logΩ · cm) | Core material exposure ratio (atom %) |
| Example 1 | | | | | | | |
| Black | (1) | B | 130.5 | Particles (A) | I | 12 | 20 |
| Cyan | | B | 127.5 | Particles (A) | I | 12 | 20 |
| Magenta | | B | 130.2 | Particles (A) | I | 12 | 20 |
| Yellow | | B | 128.5 | Particles (A) | I | 12 | 20 |
| Example 2 | (2) | B | 130.5 | Particles (B) | II | 13 | 15 |
| Example 3 | (3) | B | 130.5 | RY200 | III | 12 | 18 |
| Example 4 | (4) | B | 130.5 | RY200 | IV | 11 | 5 |
| Example 5 | (5) | B | 130.5 | RY200 | V | 9 | 10 |
| Comparative Example 1 | (6) | A | 145.5 | RY200 | V | 9 | 10 |
| Comparative Example 2 | (7) | B | 130.5 | RY200 | VI | 13 | 18 |
| Comparative Example 3 | (8) | B | 130.5 | RY200 | VII | 13 | 10 |
| Comparative Example 4 | (9) | B | 130.5 | RY200 | VIII | 10 | 12 |
| Comparative Example 5 | (10) | B | 130.5 | RY200 | IX | 10 | 5 |
| Comparative Example 6 | (11) | B | 130.5 | Titania | IV | 11 | 5 |

TABLE 2

| | | Initial stage | | | | | After 40,000 sheets had been printed | | | | | | |
|---|---|---|---|---|---|---|---|---|---|---|---|---|---|
| | | Toner charging property | | | Image quality | | Toner charging property | | | | | Image quality | |
| | Developing agent No. | High temperature and high humidity (μC/g) | Low temperature and low humidity (μC/g) | Judgment | Fog on paper | Solid image density | High temperature and high humidity (μC/g) | Low temperature and low humidity (μC/g) | Change amount in high temperature and high humidity | Change amount in low temperature and low humidity | Judgment | Fog on paper | Solid image density |
| Example 1 | | | | | | | | | | | | | |
| Black | (1) | −32.5 | −34.5 | ○ | ○ | ○ | −28.3 | −32.3 | 4.2 | 2.3 | Δ | ○ | ○ |
| Cyan | | −35.2 | −35.3 | ○ | ○ | ○ | −32.3 | −32.1 | 2.9 | 3.2 | Δ | ○ | ○ |
| Magenta | | −34.6 | −34.4 | ○ | ○ | ○ | −31.2 | −32.3 | 3.4 | 2.1 | Δ | ○ | ○ |
| Yellow | | −35.6 | −37.3 | ○ | ○ | ○ | −34.8 | −34.5 | 0.8 | 2.8 | ○ | ○ | ○ |
| Example 2 | (2) | −35.8 | −34.5 | ○ | ○ | ○ | −32.5 | −32.4 | 3.3 | 2.1 | Δ | ○ | ○ |
| Example 3 | (3) | −35.9 | −36.1 | ○ | ○ | ○ | −32.4 | −34.3 | 3.5 | 1.8 | Δ | ○ | ○ |
| Example 4 | (4) | −26.6 | −27.8 | ○ | ○ | ○ | −25.6 | −25.1 | 1.0 | 2.7 | ○ | ○ | ○ |
| Example 5 | (5) | −28.3 | −30.5 | ○ | ○ | ○ | −25.5 | −28.3 | 2.8 | 2.2 | ○ | ○ | ○ |
| Comparative Example 1 | (6) | −25.8 | −26.5 | ○ | ○ | ○ | −15.3 | −17.5 | 10.5 | 9.0 | X | X | ○ |
| Comparative Example 2 | (7) | −30.8 | −40.8 | X | ○ | ○ | −28.5 | −37.5 | 2.3 | 3.3 | Δ | Δ | X |
| Comparative Example 3 | (8) | −15.8 | −16.8 | ○ | X | ○ | — | — | — | — | — | — | — |
| Comparative Example 4 | (9) | −14.6 | −16.1 | ○ | X | ○ | — | — | — | — | — | — | — |
| Comparative Example 5 | (10) | −17.5 | −18.0 | ○ | X | ○ | — | — | — | — | — | — | — |
| Comparative Example 6 | (11) | −26.5 | −27.5 | ○ | ○ | ○ | −13.3 | −13.8 | 13.2 | 13.7 | X | X | ○ |

As is clear from Table 2, the developing agents (1) to (5) of Examples 1 to 5 according to the present invention all exhibited charge environmental stability and charge retainability at satisfactory levels.

On the other hand, when a toner having a large shape factor was used as in Comparative Example 1, charge retainability was poor. This is supposedly because an irregular shape of the toner decreases an area that can be charged and brought into contact with a carrier. Further, when a quaternary ammonium salt compound was not contained in a carrier coat layer as in Comparative Example 2, charge environmental stability could not be obtained. In a carrier coated with a resin not having a high positively charging tendency in Comparative Examples 3 to 5, a charge level was low from the beginning and fog occurred in a non-imaging portion, though charge environmental stability was ensured. In Comparative Example 6, in which a toner surface was covered with titania having a low electric resistivity, charge retainability was poor though charge environmental stability was ensured.

The invention, by adopting the above-mentioned construction, can provide an electrostatic latent image developing agent excellent in charging property, charge retainability and environmental stability; and can also provide an image forming method capable of forming a high quality image.

What is claimed is:

1. An electrostatic latent image developing agent comprising a toner and a carrier, wherein:

the surface of the toner is covered with a plurality of particles that comprises:

at least first particles having a volume resistivity of $1\times10^{14}$ Ωcm or greater and an average primary particle diameter in a range of 40 nm to 50 nm, and second particles having a volume resistivity of $1\times10^{14}$ Ωcm or greater and an average primary particle diameter of less than 50 nm, wherein a total covering ratio on the surface of the toner of the second particles is higher than a total covering ratio of said at least first particles, and a sum of the total covering ratios of said at least first particles and said second particles is higher than a total covering ratio of other particles present on the toner surface;

a shape factor SF1 of the toner is in the range of from 100 to 140;

the carrier is a resin coated carrier; and at least a coating resin layer of the resin coated carrier comprises a positively charging resin and a quaternary ammonium salt compound.

2. An electrostatic latent image developing agent according to claim 1, wherein a volume resistivity of the carrier is in the range of from $1\times10^{9}$ Ωcm to $1\times10^{13}$ Ωcm.

3. An electrostatic latent image developing agent according to claim 1, wherein a core material component exposure ratio of the carrier is 20% or less.

4. An electrostatic latent image developing agent according to claim 1, wherein the toner is manufactured by a wet method.

5. An electrostatic latent image developing agent according to claim 1, wherein the particles comprise silicone-treated silica.

6. An electrostatic latent image developing agent according to claim 1, wherein a content of the quaternary ammonium salt compound is in the range of from 1 to 60 parts by mass per 100 parts by mass of the positively charging resin.

7. An electrostatic latent image developing agent according to claim 1, wherein an amount of the positively charging resin is in the range of from 0.05 to 5.0% by mass with respect to a total mass of the carrier.

8. An electrostatic latent image developing agent according to claim 1, wherein an average film thickness of the positively charging resin is in the range of from 0.1 to 10 μm.

9. An electrostatic latent image developing agent according to claim 1, wherein a volume resistivity of the carrier is in the range of from $10^{9}$ to $10^{13}$ Ωcm at a development contrast potential in the range of from $10^{3}$ to $10^{4}$ V/cm.

10. An electrostatic latent image developing agent according to claim 1, wherein an amount of the particles is in the range of from 0.3 to 5 parts by mass per 100 parts by mass of the toner.

11. An electrostatic latent image developing agent according to claim 1, wherein a volume average particle diameter of the toner is in the range of from 2 to 12 μm.

12. An electrostatic latent image developing agent according to claim 1, wherein a ratio of a volume average particle diameter of the carrier to a volume average particle diameter of the toner is in the range of from 2:1 to 15:1.

13. An image forming method comprising at least:

a charging step of charging a surface of an electrostatic latent image bearing member;

an electrostatic latent image forming step of forming an electrostatic latent image on the surface of the electrostatic latent image bearing member;

a developing step of transforming the electrostatic latent image into a toner image by using an electrostatic latent image developing agent;

a transfer step of transferring the toner image formed on the surface of the electrostatic latent image bearing member onto a surface of a receiving substrate;

a fixing step of thermally fixing the toner image transferred onto the surface of the receiving substrate; and a cleaning step of removing the toner remaining on the surface of the electrostatic latent image bearing member, wherein:

the electrostatic latent image developing agent comprises a toner and a carrier;

the surface of the toner is covered with a plurality of particles that comprises:

at least first particles having a volume resistivity of $1\times10^{14}$ Ωcm or greater and an average primary particle diameter in a range of 40 nm to 50 nm, and second particles having a volume resistivity of $1\times10^{14}$ Ωcm or greater and an average primary particle diameter of less than 50 nm, wherein a total covering ratio on the surface of the toner of the second particles is higher than a total covering ratio of said at least first particles, and a sum of the total covering ratios of said at least first particles and said second particles is higher than a total covering ratio of other particles present on the toner surface;

a shape factor SF1 of the toner is in the range of from 100 to 140;

the carrier is a resin coated carrier; and at least a coating resin layer of the resin coated carrier comprises a positively charging resin and a quaternary ammonium salt compound.

14. An image forming method according to claim 13, wherein a volume resistivity of the carrier is in the range of from $1\times10^{9}$ Ωcm to $1\times10^{13}$ Ωcm.

15. An image forming method according to claim 13, wherein a core material component exposure ratio of the carrier is 20% or less.

16. An image forming method according to claim 13, wherein the toner is manufactured by a wet method.

17. An image forming method according to claim 13, wherein the particles comprise silicone-treated silica.

18. An image forming method according to claim 13, wherein a content of the quaternary ammonium salt compound is in the range of from 1 to 60 parts by mass per 100 parts by mass of the positively charging resin.

* * * * *